US011054153B2

(12) United States Patent
Myeong et al.

(10) Patent No.: US 11,054,153 B2
(45) Date of Patent: Jul. 6, 2021

(54) AIR CONDITIONER

(71) Applicant: Samsung Electronics Co., Ltd, Suwon-si (KR)

(72) Inventors: Seong Ryeol Myeong, Suwon-si (KR); Moon Sun Shin, Suwon-si (KR); Jong Chul Ahn, Seoul (KR); Dong Yoon Lee, Suwon-si (KR); Sung June Cho, Suwon-si (KR); Jung Un Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/765,224

(22) PCT Filed: Sep. 28, 2016

(86) PCT No.: PCT/KR2016/010850
§ 371 (c)(1),
(2) Date: Mar. 30, 2018

(87) PCT Pub. No.: WO2017/057898
PCT Pub. Date: Apr. 6, 2017

(65) Prior Publication Data

US 2018/0299142 A1 Oct. 18, 2018

(30) Foreign Application Priority Data

Sep. 30, 2015 (KR) ..... 10-2015-0137524

(51) Int. Cl.
*F24F 1/02* (2019.01)
*F24F 13/20* (2006.01)
(Continued)

(52) U.S. Cl.
CPC ..... *F24F 1/02* (2013.01); *F24F 1/04* (2013.01); *F24F 1/40* (2013.01); *F24F 3/14* (2013.01);
(Continued)

(58) Field of Classification Search
CPC ..... F24F 1/04; F24F 2013/202; F24F 1/40; F04B 39/0044; F25B 2500/13
See application file for complete search history.

(56) References Cited

U.S. PATENT DOCUMENTS 2,394,666 A * 2/1946 Cloedy ..... F02M 3/08 411/130
2,906,990 A * 9/1959 Cain ..... H01R 4/489 439/723
(Continued)

FOREIGN PATENT DOCUMENTS

CN 1991168 A 7/2007
CN 201740197 U 2/2011
(Continued)

OTHER PUBLICATIONS

International Search Report dated Dec. 14, 2016 in connection with International Patent Application No. PCT/KR2016/010850.
(Continued)

*Primary Examiner* — Kun Kai Ma

(57) ABSTRACT

Disclosed is an air conditioner with a compressor fixation structure having improved product reliability due to strengthened hardness of a boss. The air conditioner includes a compressor for compressing a refrigerant, a base for supporting the compressor, a compressor support coupled to the base to support the compressor; at least one boss protruding from the base, a vibration absorption member for absorbing vibration generated by the compressor, and a fastening member, wherein the fastening member is inserted into the boss and the vibration absorption member, and at
(Continued)

least a portion of the fastening member protrudes below a bottom surface of the base.

14 Claims, 18 Drawing Sheets

(51) Int. Cl.
*F24F 13/24* (2006.01)
*F24F 1/04* (2011.01)
*F24F 3/14* (2006.01)
*F24F 1/40* (2011.01)

(52) U.S. Cl.
CPC ..... *F24F 3/1405* (2013.01); *F24F 13/20* (2013.01); *F24F 13/24* (2013.01); *F24F 2013/202* (2013.01); *F24F 2221/12* (2013.01)

(56) References Cited

U.S. PATENT DOCUMENTS

| | | | | |
|---|---|---|---|---|
| 3,052,435 | A * | 9/1962 | Roller | F16F 3/10 248/569 |
| 3,218,906 | A * | 11/1965 | Dupree | F16B 41/002 411/533 |
| 4,387,497 | A * | 6/1983 | Gulistan | B23P 11/00 29/511 |
| 5,313,806 | A * | 5/1994 | Feng | F16F 1/3732 62/262 |
| 6,029,942 | A * | 2/2000 | Daddis, Jr. | F04B 39/0044 248/635 |
| 2007/0039464 | A1 | 2/2007 | Vanderhoof et al. | |
| 2007/0148013 | A1 | 6/2007 | Hong et al. | |
| 2009/0229290 | A1* | 9/2009 | Kim | F24F 13/24 62/259.1 |
| 2010/0068003 | A1* | 3/2010 | Wagner | B21H 3/02 411/386 |
| 2014/0037398 | A1* | 2/2014 | Grojean | F16B 37/067 411/3 |
| 2015/0010375 | A1* | 1/2015 | Schraer | F16B 25/0021 411/414 |
| 2015/0047383 | A1 | 2/2015 | Hong et al. | |

FOREIGN PATENT DOCUMENTS

| | | | | |
|---|---|---|---|---|
| CN | 203067654 | U | | 7/2013 |
| CN | 203404871 | U | | 1/2014 |
| CN | 104220817 | A | | 12/2014 |
| CN | 104422038 | A | | 3/2015 |
| CN | 204611946 | U | | 9/2015 |
| EP | 2101116 | A2 | | 9/2009 |
| JP | 63-045475 | A | | 2/1988 |
| JP | 11002439 | A | * | 1/1999 |
| JP | 2000-205590 | A | | 7/2000 |
| JP | 2000205590 | A | * | 7/2000 |
| JP | 2002089889 | A | | 3/2002 |
| JP | 2012177315 | A | | 9/2012 |
| JP | 2012177335 | A | | 9/2012 |
| KR | 10-2004-0078938 | A | | 9/2004 |
| KR | 10-2007-0006456 | A | | 1/2007 |
| KR | 10-2013-0106737 | A | | 9/2013 |

OTHER PUBLICATIONS

Written Opinion of the International Searching Authority dated Dec. 14, 2016 in connection with International Patent Application No. PCT/KR2016/010850.

Supplementary European Search Report dated Aug. 14, 2018 in connection with European Patent Application No. 16852044, 9 pages.

China National Intellectual Property Administration, "Text of the First Office Action," Application No. CN201680058130.8, dated Oct. 9, 2019, 34 pages.

The Second Office Action in connection with Chinese Application No. 201680058130.8 dated Jun. 17, 2020, 14 pages.

Rejection Decision dated Oct. 26, 2020 in connection with Chinese Application No. 201680058130.8, 14 pages.

* cited by examiner

【Fig. 1】
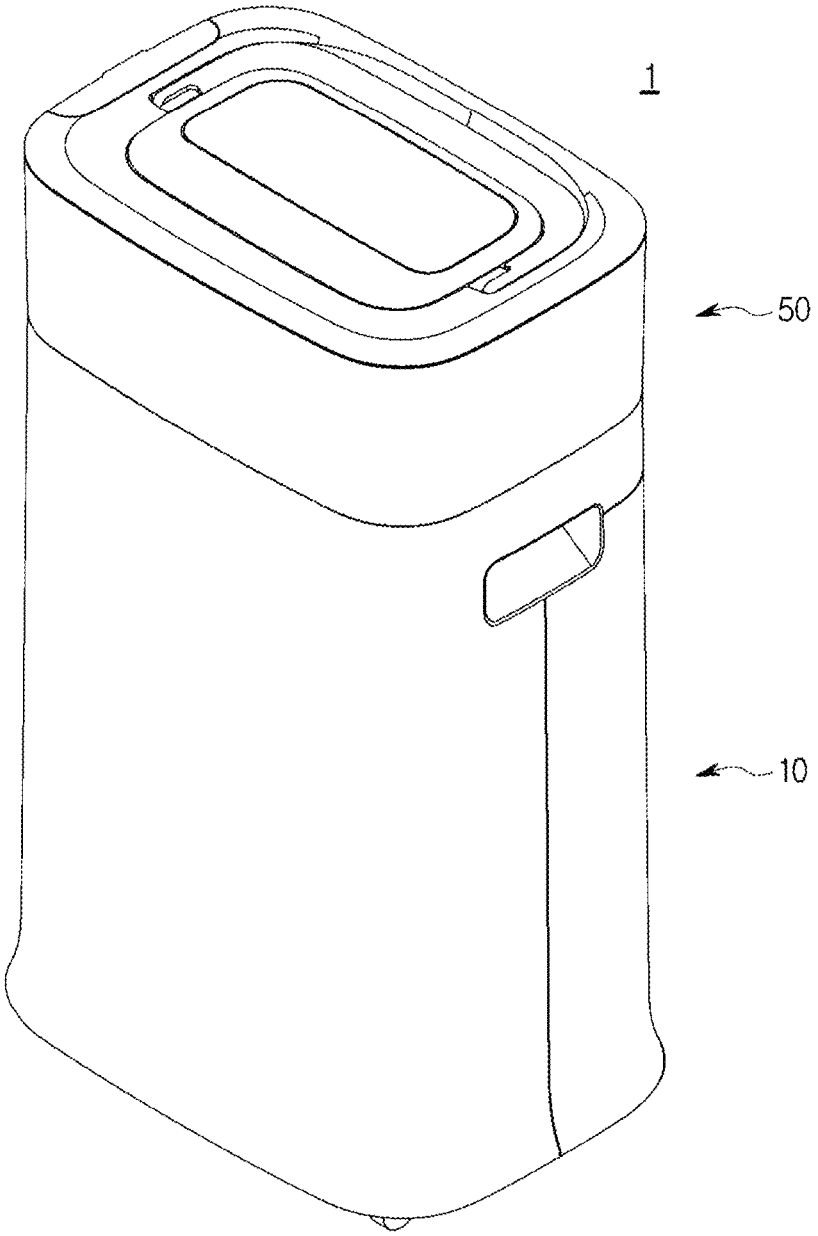

【Fig. 2】
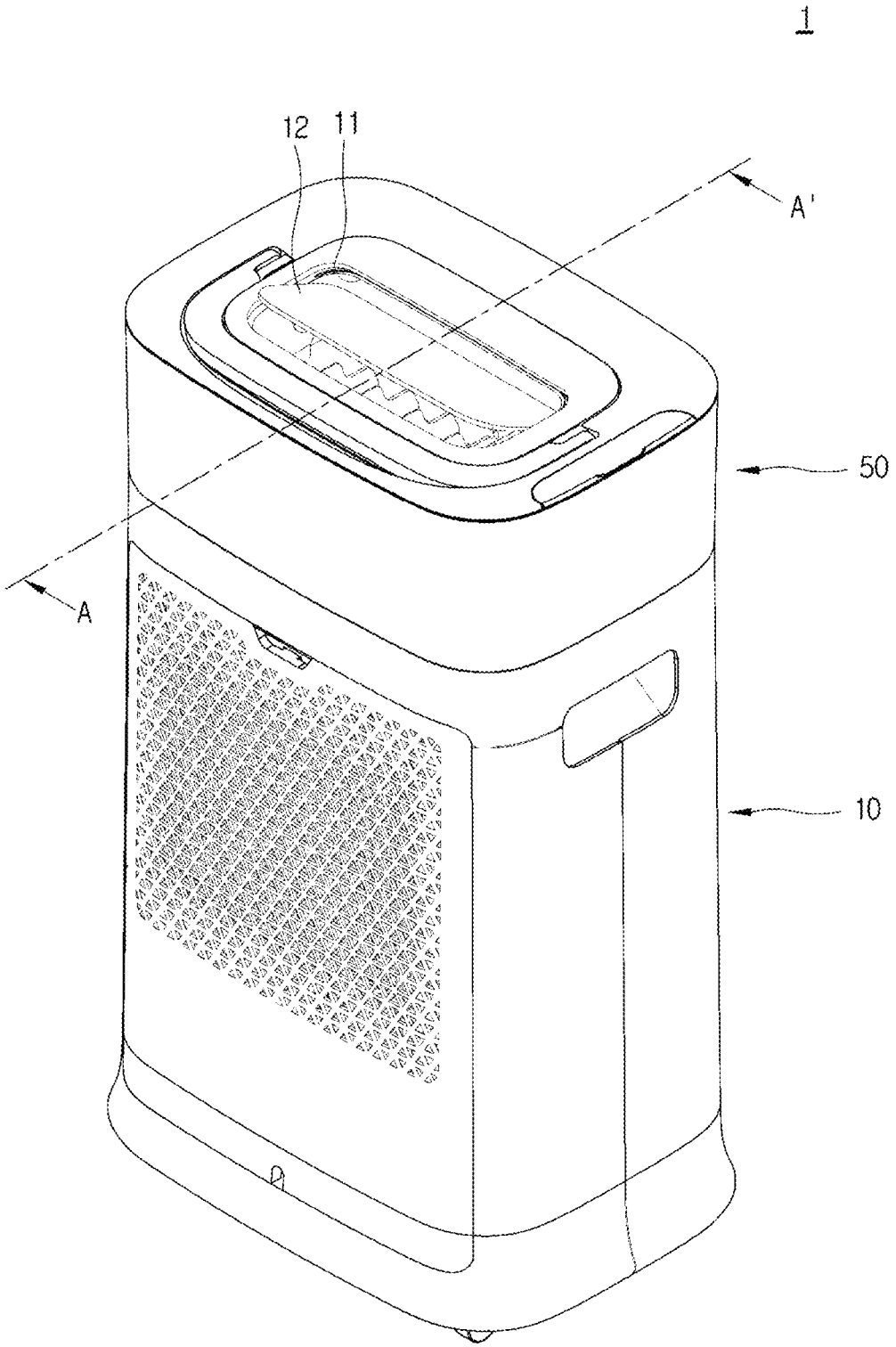

【Fig. 3】
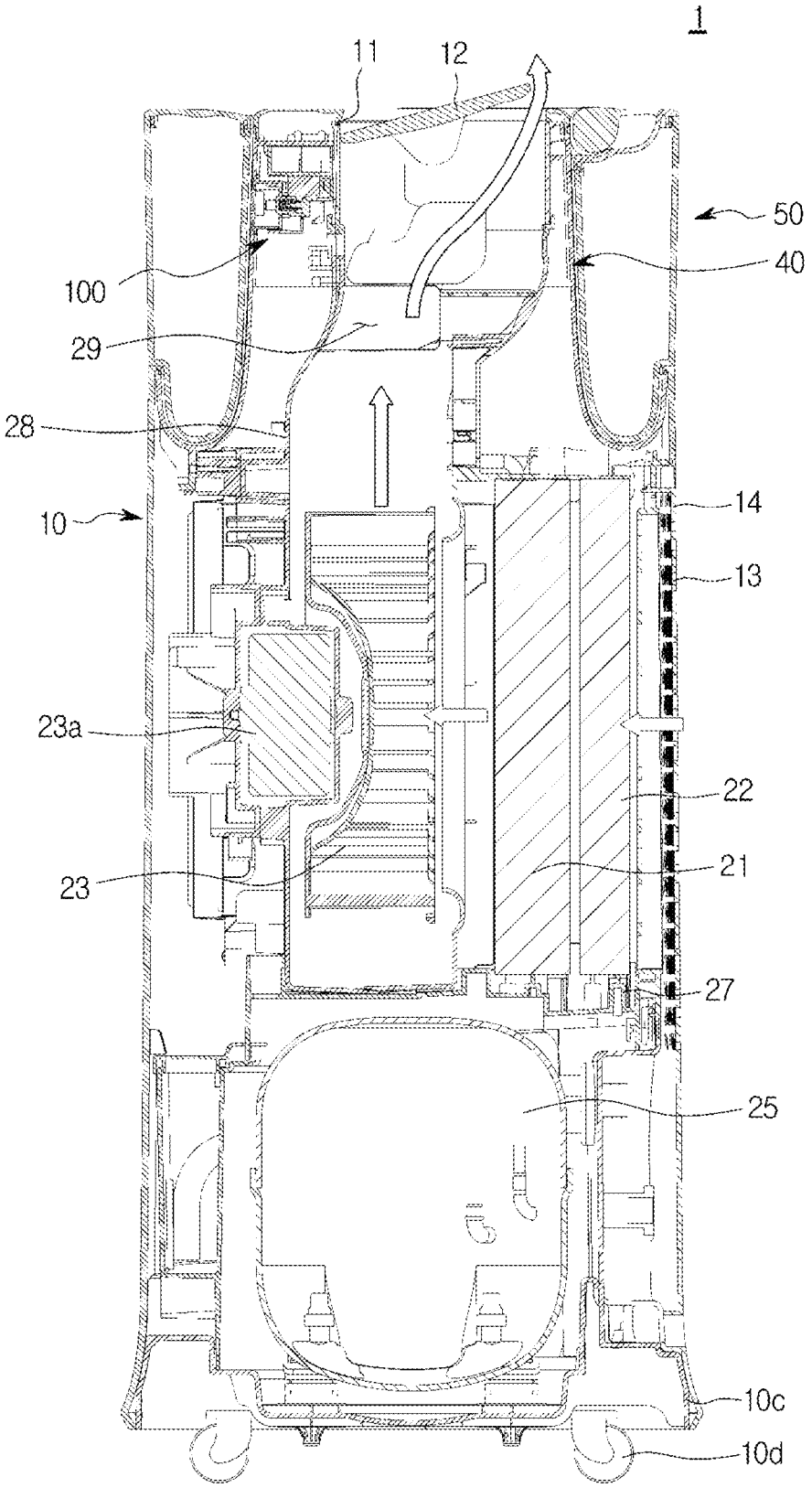

[Fig. 4]
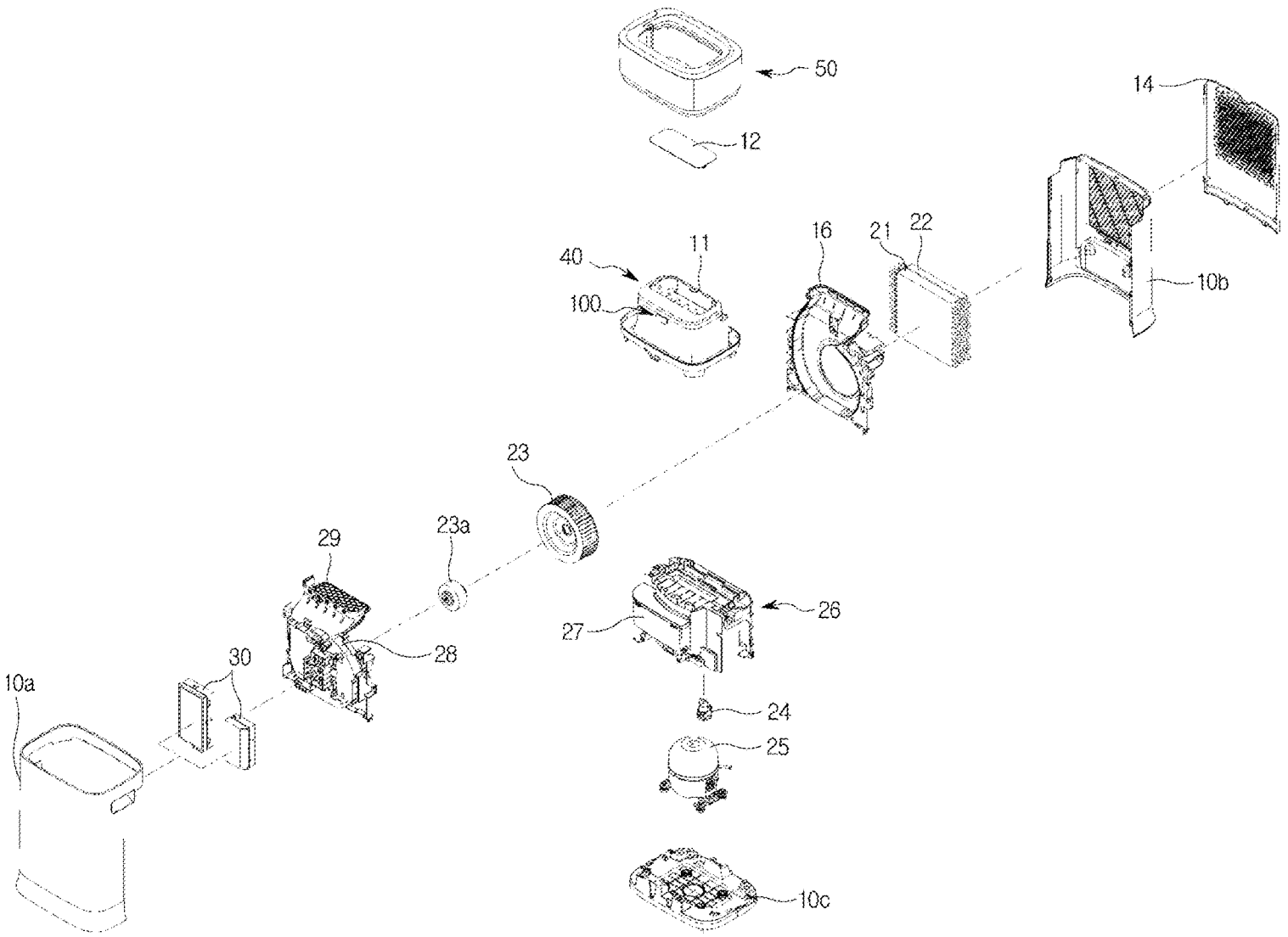

【Fig. 5】
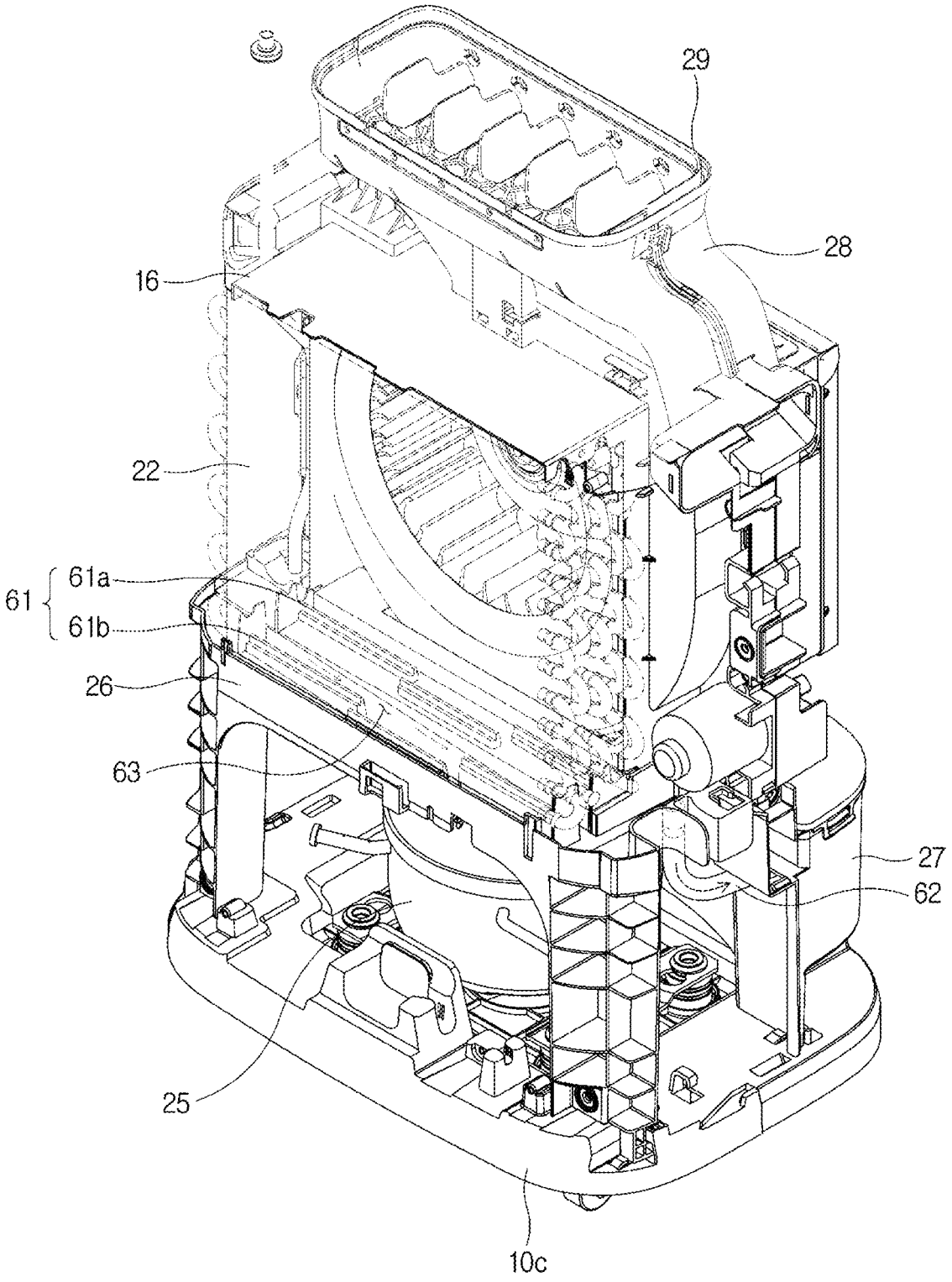

【Fig. 6】
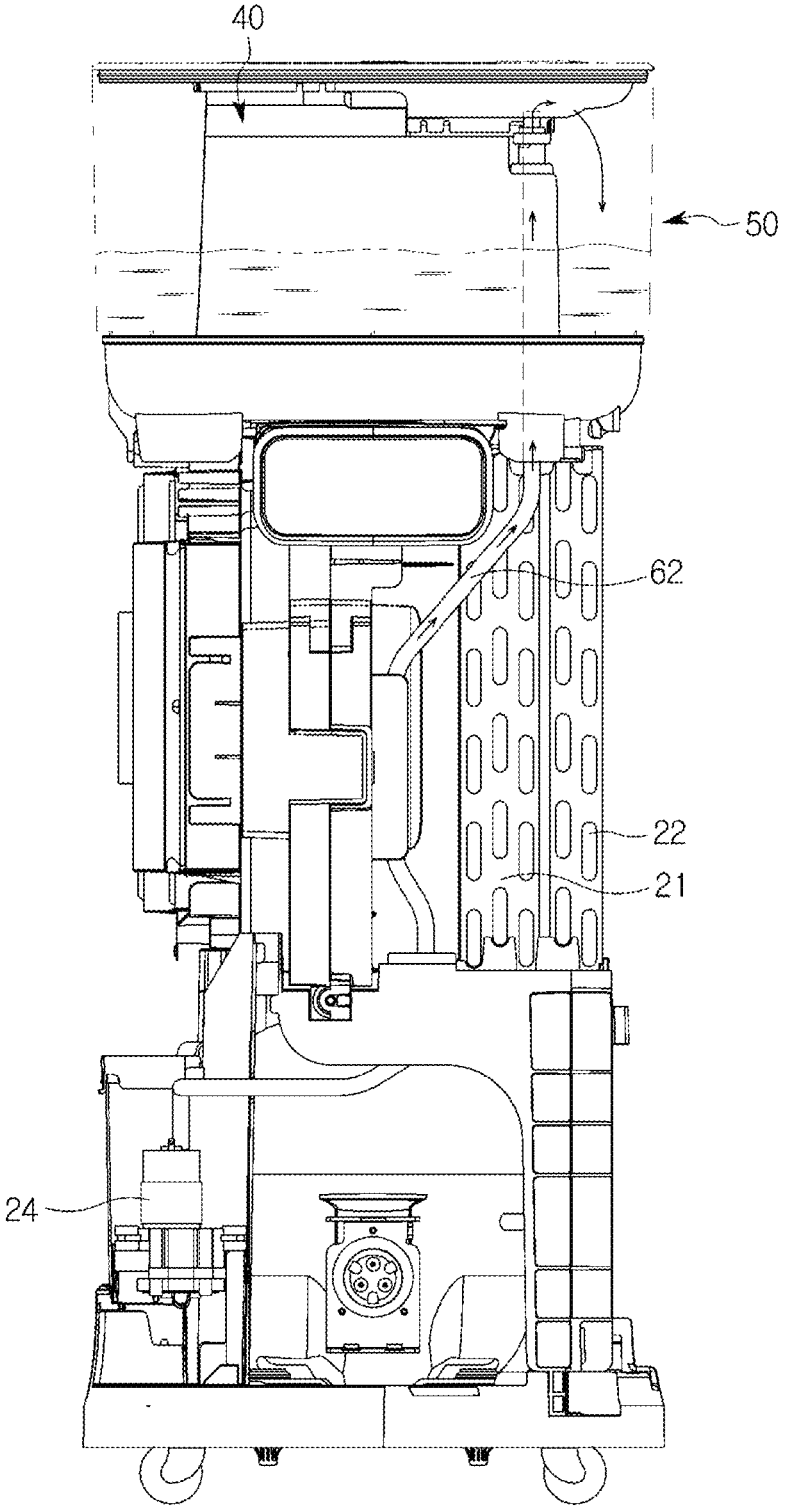

【Fig. 7】
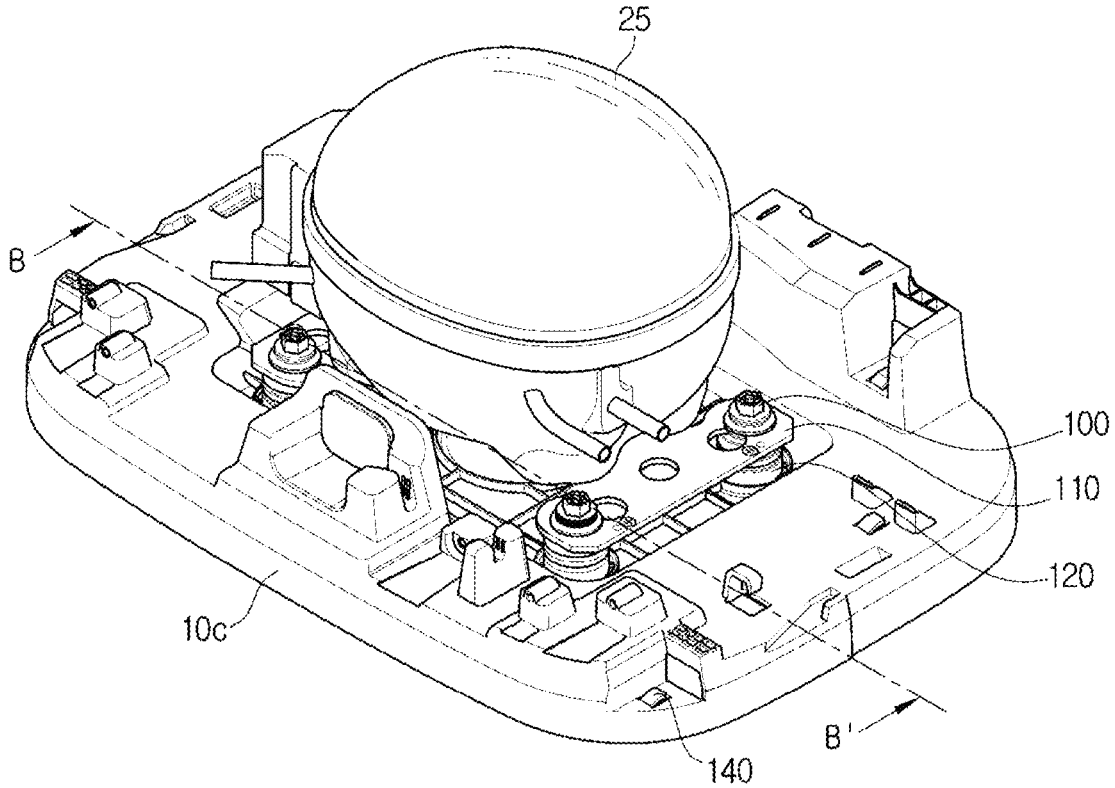

【Fig. 8】
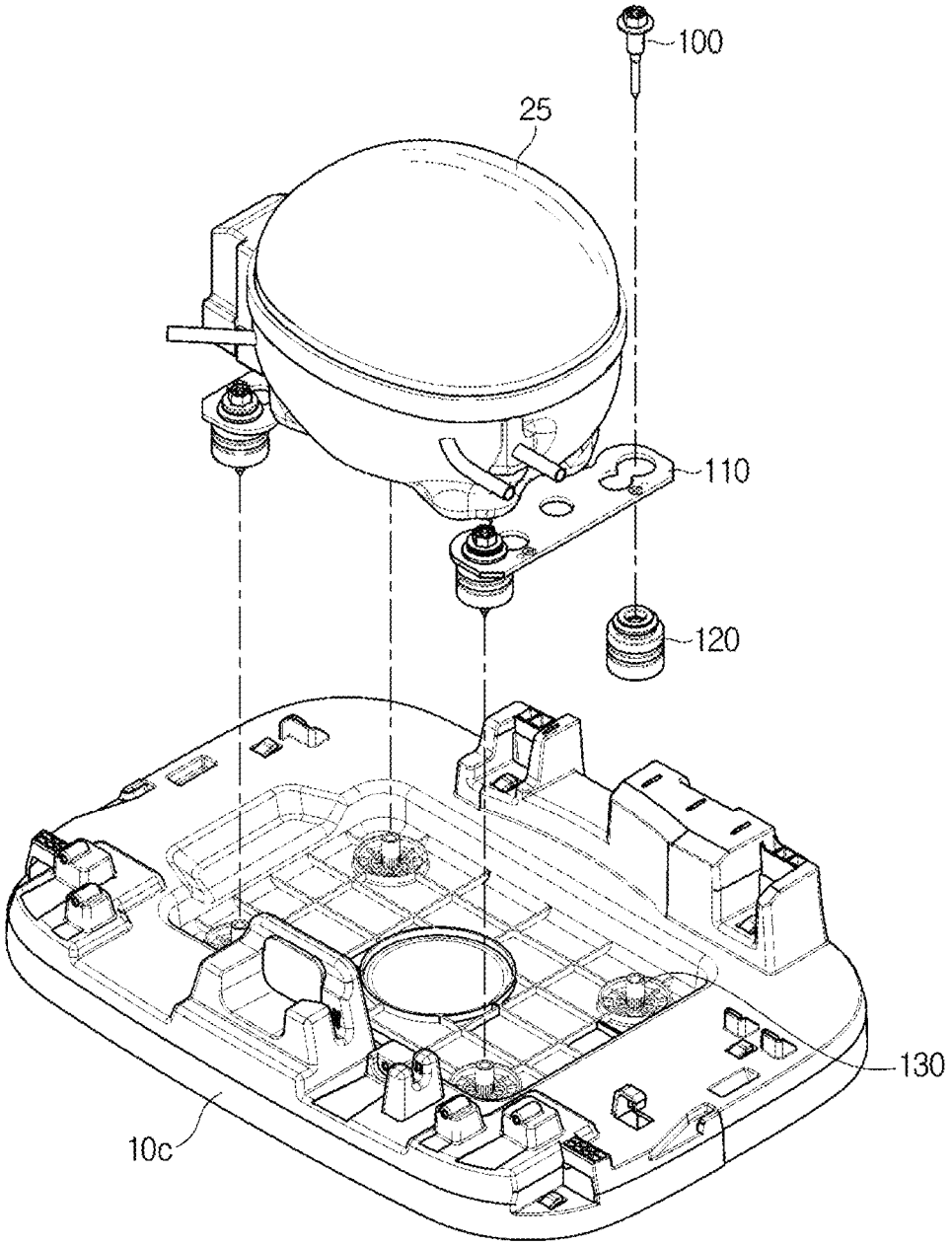

【Fig. 9】
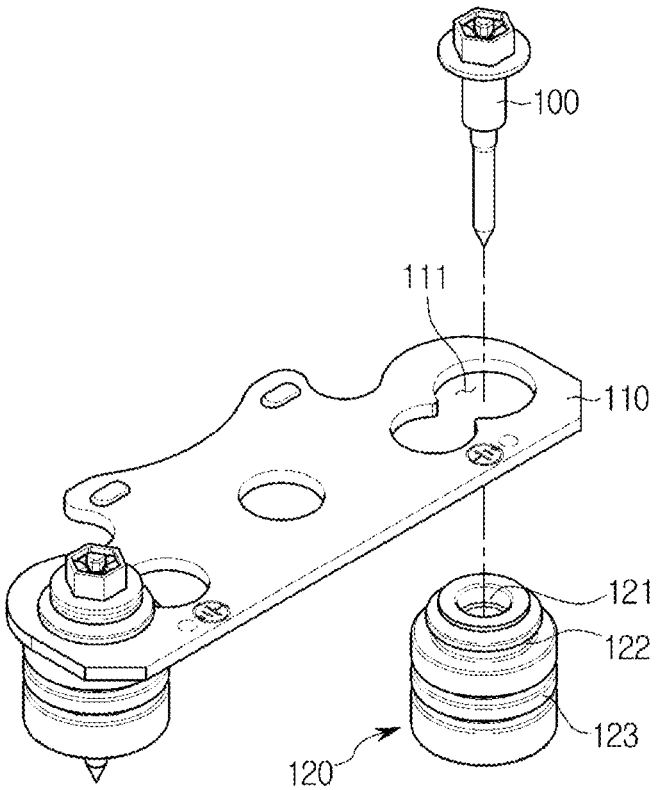

【Fig. 10】
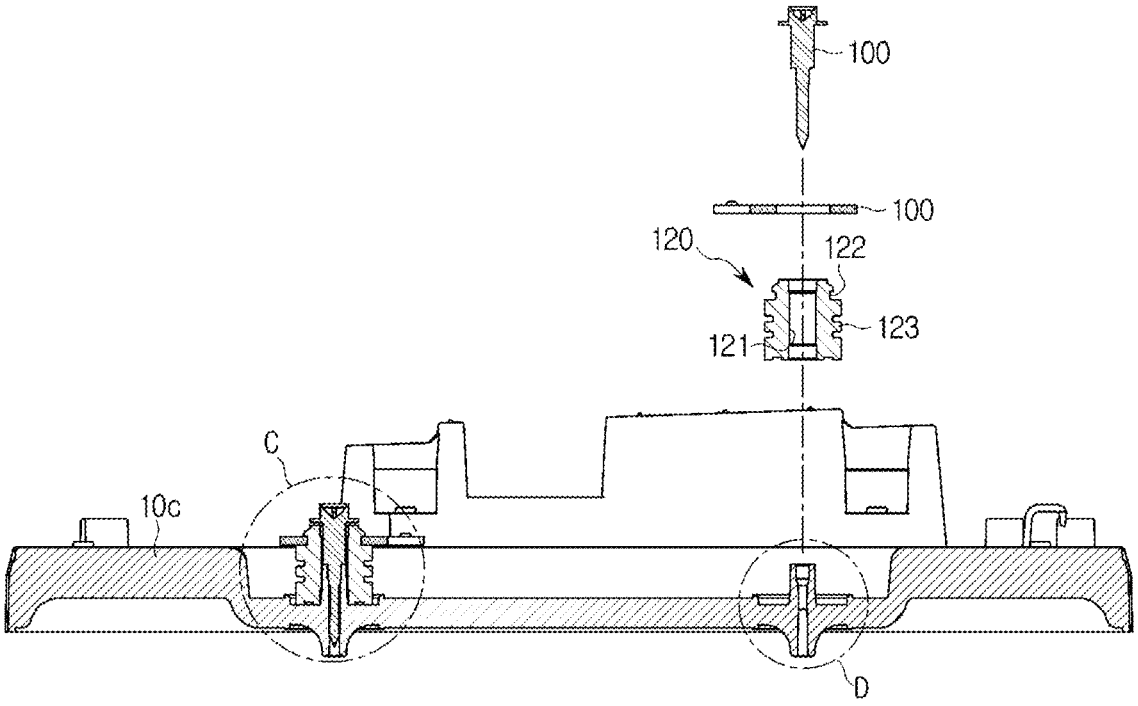

【Fig. 11】
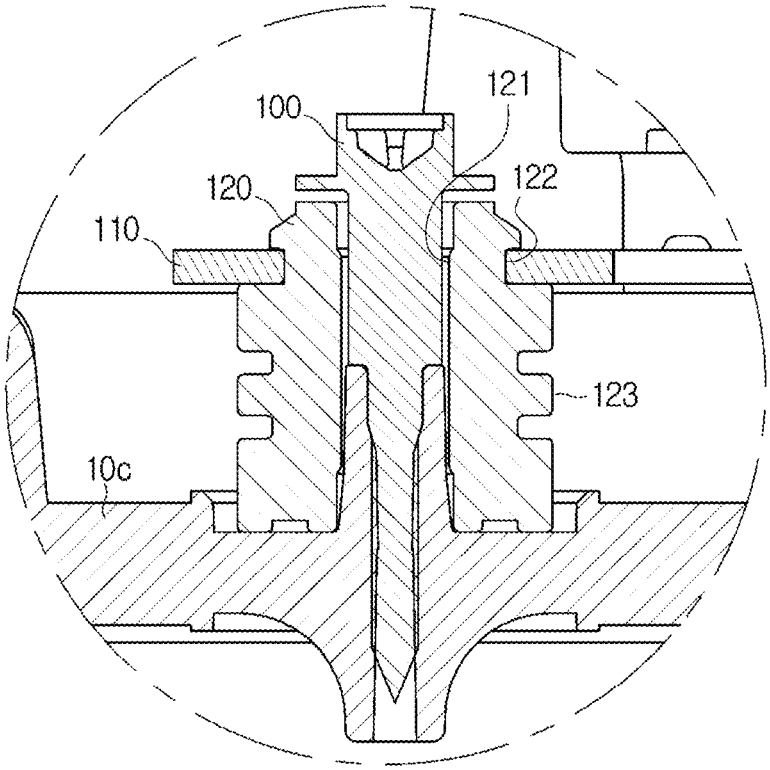

【Fig. 12】
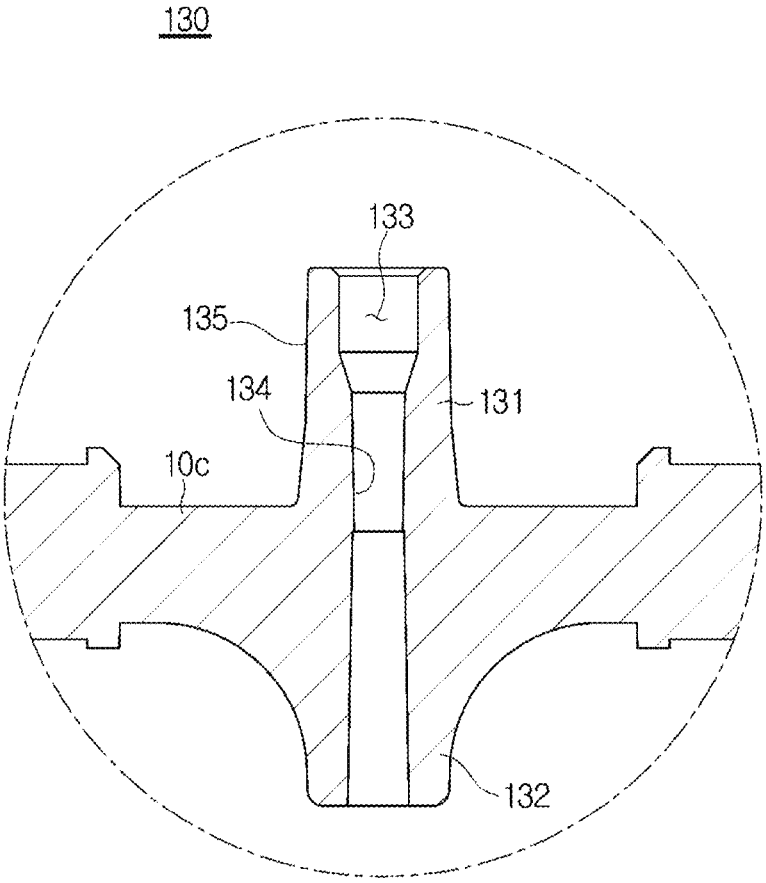

【Fig. 13】
100
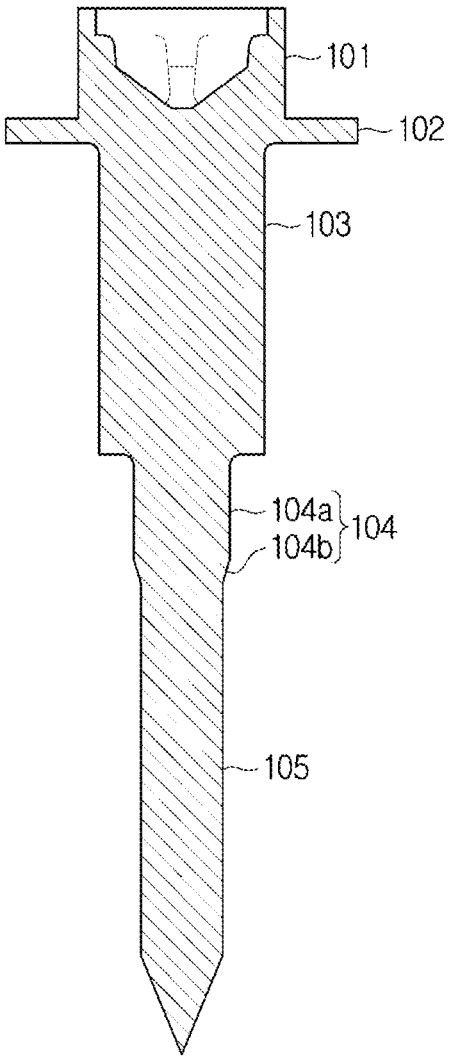

【Fig. 14】
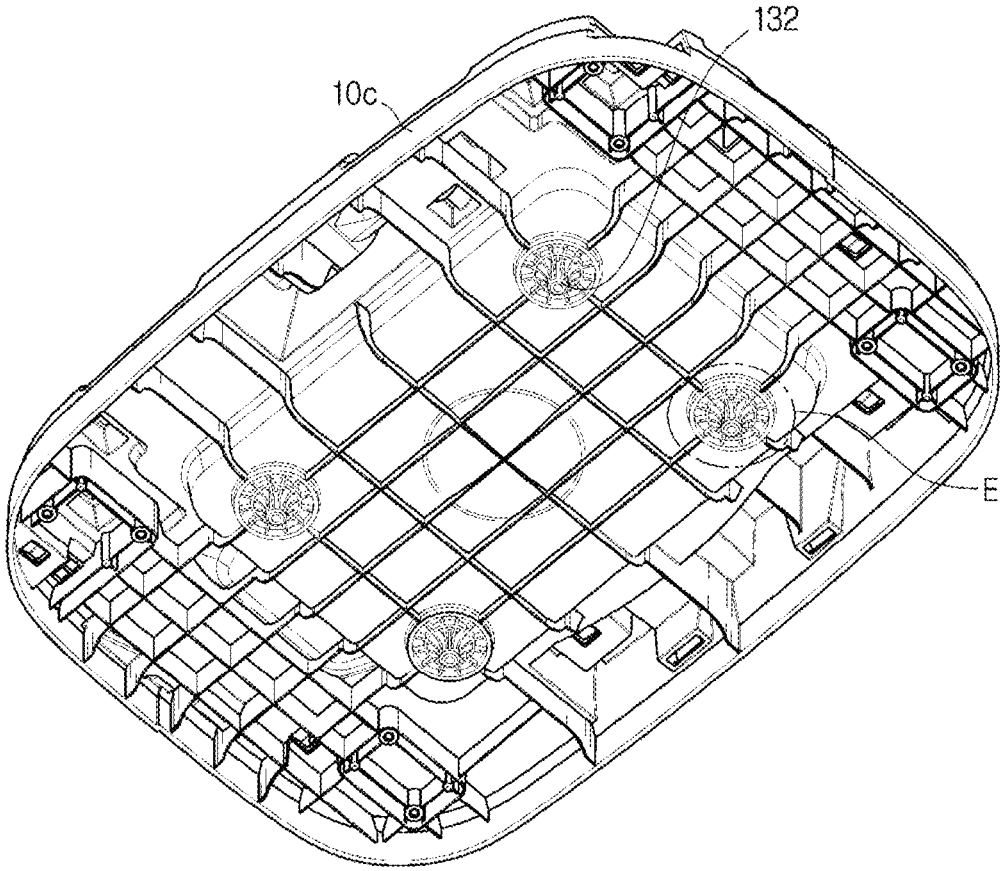

【Fig. 15】
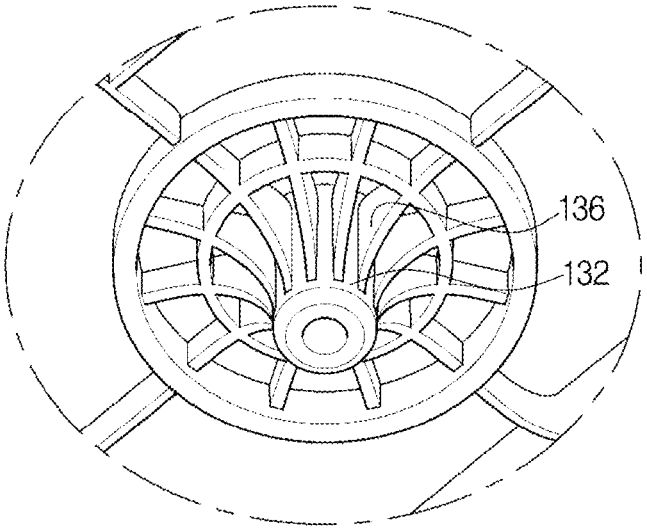

【Fig. 16】
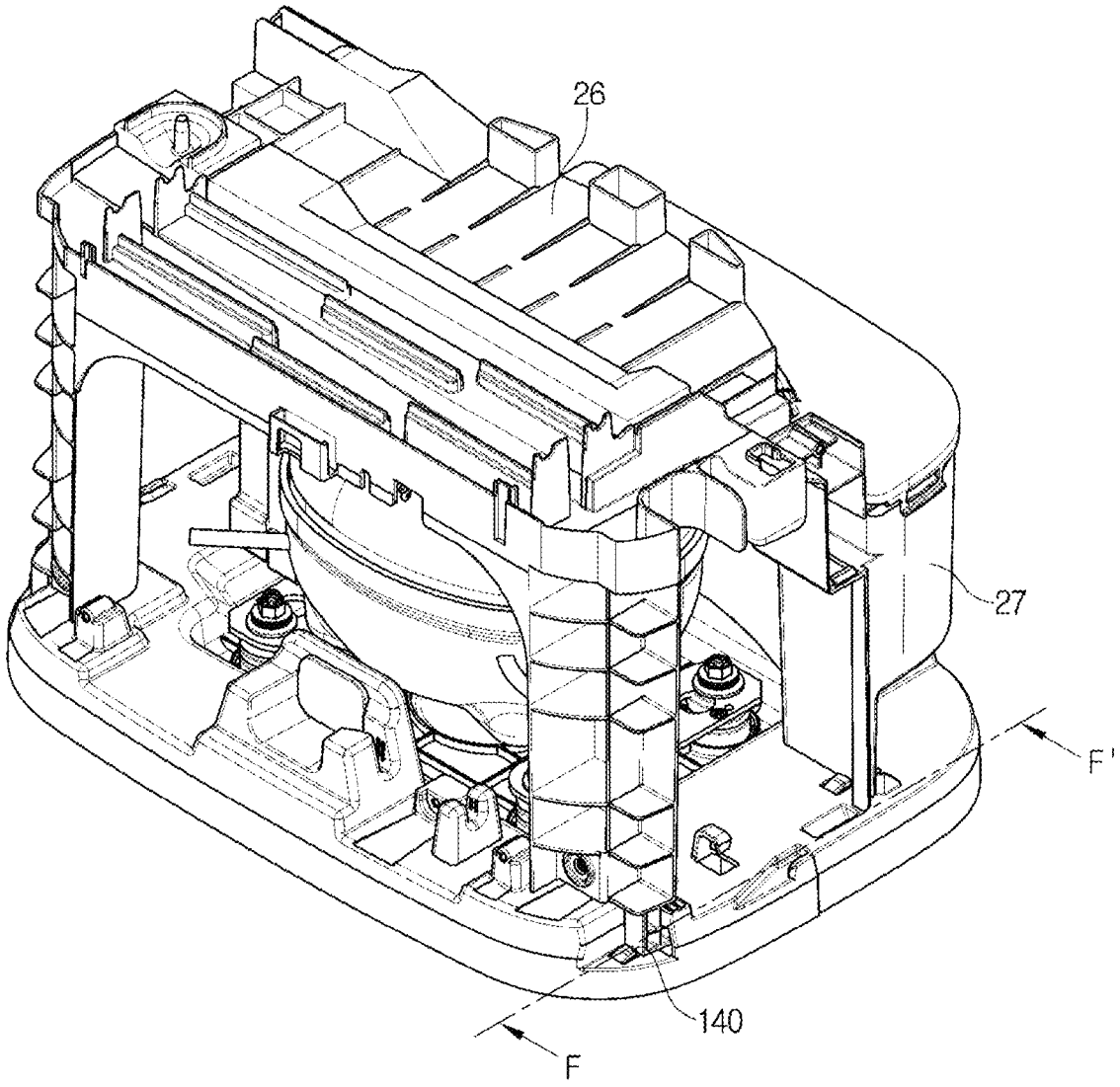

【Fig. 17】
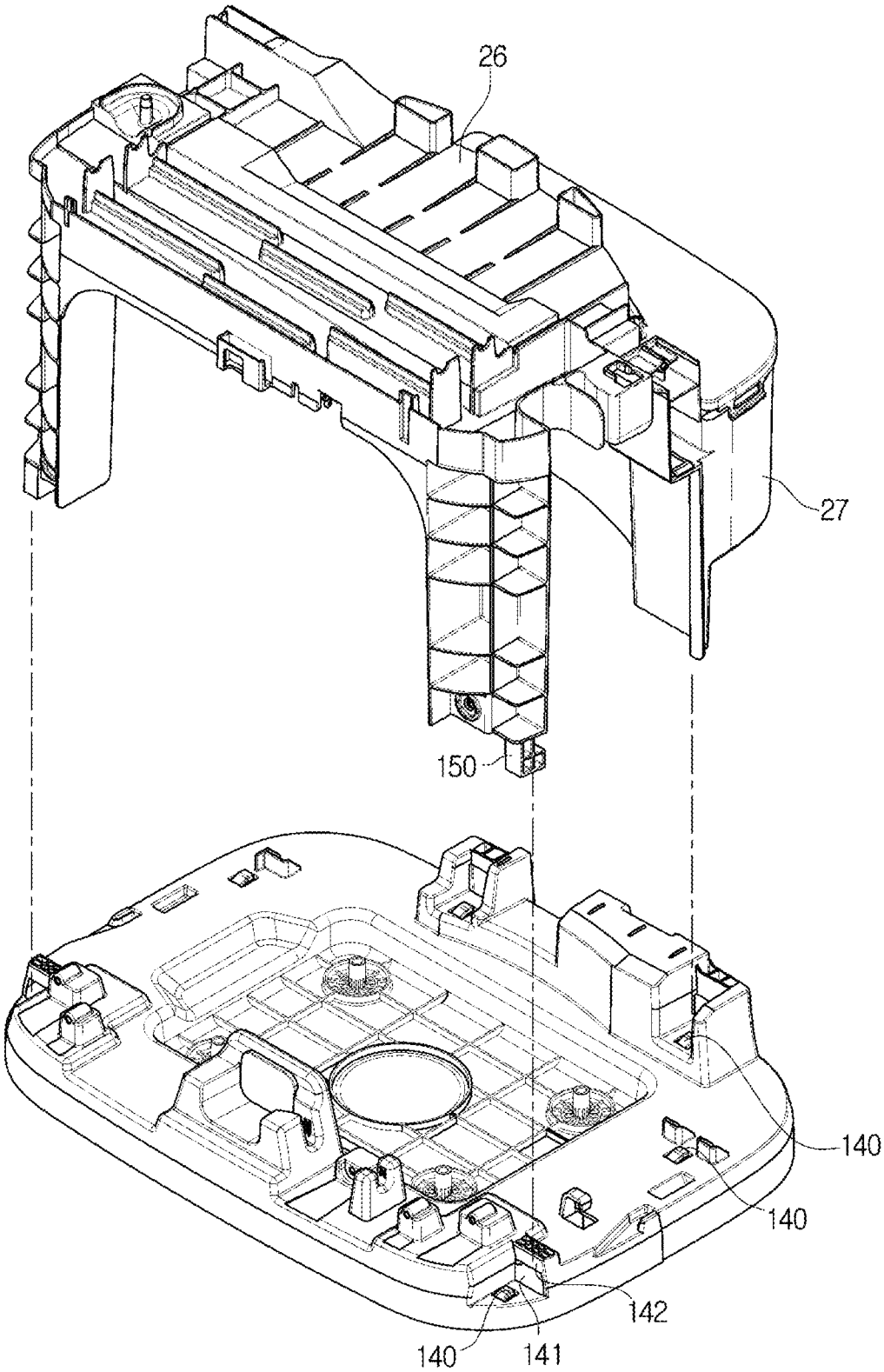

【Fig. 18】
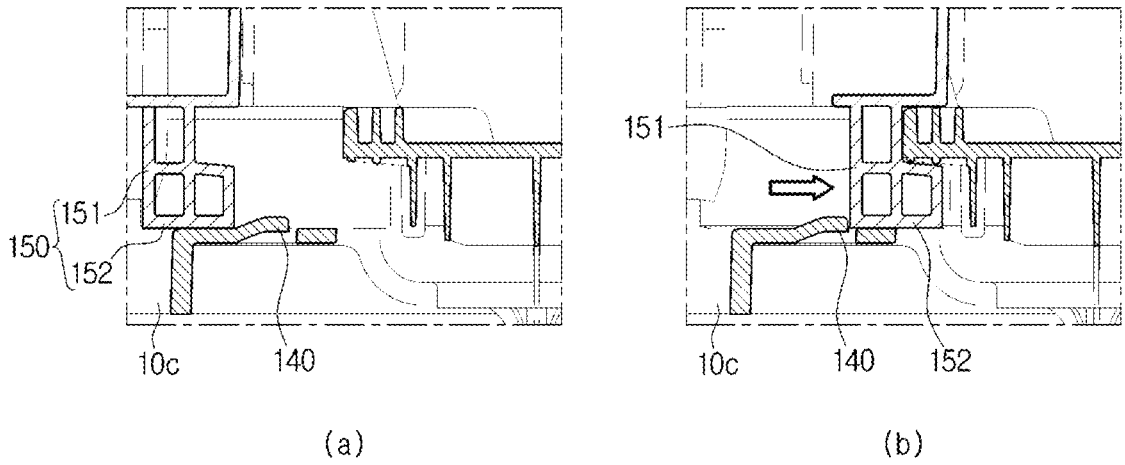

AIR CONDITIONER

CROSS-REFERENCE TO RELATED APPLICATION(S) AND CLAIM OF PRIORITY

This application is a 371 of International Application No. PCT/KR2016/010850 filed Sep. 28, 2016, which claims priority to Korean Patent Application No. 10-2015-0137524 filed Sep. 30, 2015, the disclosures of which are herein incorporated by reference in their entirety.

TECHNICAL FIELD

The present invention relates to an air conditioner including a dehumidifier, and more particularly, to a compressor fixing structure of which reliability is improved and a tray drain fixing structure of which productivity and serviceability are improved.

BACKGROUND

Generally, air conditioners are apparatuses configured to adjust temperature, humidity, air flow, distribution, and the like to be suitable for human activity using a refrigeration cycle, and to remove dust in air.

An air conditioner includes a dehumidifier, and generally, a dehumidifier is a device configured to suction humid air of an indoor space into the inside of a case, lower humidity by allowing the humid air to pass through a heat exchanger formed of a condenser and an evaporator through which a refrigerant flows, and then lower indoor humidity by discharging the dehumidified air into the indoor space again.

Such a dehumidifier lowers the humidity by removing as much moisture included in air as an amount of condensate generated when the air is cooled to a dew point or less, and generally a dehumidification method which uses a refrigeration cycle is widely used.

A dehumidifier using the dehumidification method which uses a refrigeration cycle may include a heat exchanger including an evaporator and a condenser, a compressor configured to circulate a refrigerant in the heat exchanger, and a blowing fan configured to suction air.

The compressor is mounted on one side of a base structure of the dehumidifier, and a boss may be provided in the base structure to fix the compressor to the base structure. In the case of a base structure of a conventional dehumidifier, the strength of a boss is weak, and accordingly, when the boss receives a strong impact, a crack, damage, or the like may occur in the boss.

Further, a tray drain configured to guide condensate generated from the heat exchanger may be provided in the dehumidifier, and the tray drain needs to be fixed to the base structure. In order to fix the tray drain to the base structure, conventionally, hook coupling in a vertical direction has been used. In the conventional coupling method, when a hook is weakened, the hook becomes detached by an impact, and when the hook is strengthened, assembling and disassembling the dehumidifier may become difficult, and thus workability may be lowered.

SUMMARY

One aspect of the present invention provides a compressor fixing structure having few components and a simple assembly structure.

Another aspect of the present invention provides a compressor fixing structure of which strength is increased and reliability is improved.

Still another aspect of the present invention provides a compressor fixing structure in which a fastening member maintains a predetermined distance from a vibration absorption member to prevent an abnormal noise.

Yet another aspect of the present invention provides an assembly structure of a water collection structure of which productivity is improved due to simplification of an assembly structure.

An air conditioner according to an aspect of the present invention includes a compressor configured to compress a refrigerant, a base configured to support the compressor, a compressor support coupled to the base and configured to support the compressor, at least one boss configured to protrude from the base, a vibration absorption member disposed between the compressor support and the boss, and configured to absorb vibrations generated from the compressor, and a fastening member configured to couple the boss, the vibration absorption member, and the compressor support, wherein the fastening member is inserted into the boss and the vibration absorption member, and at least a part the fastening member protrudes downward from a lower surface of the base.

The fastening member may further include a body, and a lower end of the body may be supported by an upper end of the boss In the vibration absorption member, a length in a first direction, in which the fastening member is inserted into the vibration absorption member, may be formed to be greater than a length by which the boss protrudes from an upper surface of the base.

The body may be disposed to be spaced apart from the vibration absorption member.

The fastening member may further include a fastening portion configured to extend downward from the body, wherein the fastening portion may have a smaller diameter than the body.

In the fastening portion, a screw thread may be formed on an outer circumferential surface of the fastening portion so that the fastening member may be screw-coupled to the boss.

The fastening member may further include a guide provided between the fastening portion and the body, and the guide may be provided on an upper end of the fastening portion to guide insertion of the fastening member into the boss, and may include an inclined portion of which a diameter gradually decreases.

An inner diameter of the boss may vary to correspond to a diameter of the guide.

The fastening member may further include a washer provided on an upper portion of the body to prevent separation of the vibration absorption member.

The washer may be disposed to be spaced apart from the vibration absorption member.

The washer may be provided separately from the fastening member.

The fastening member may further include a head provided on an upper end of the washer.

The head may be provided in a shape to which a rotational force is applied.

The base may be integrally formed with the boss.

The vibration absorption member may be formed of an elastic material.

An air conditioner according to an aspect of the present invention includes a compressor, a base configured to support the compressor and including at least one boss, a compressor support configured to connect the base and the compressor to couple the compressor to the base, a vibration absorption member disposed to surround the outside of the boss and coupled to the compressor support, and a fastening member configured to couple the boss, the vibration absorption member and the compressor, wherein the boss includes a first boss configured to protrude upward from the base, and a second boss configured to protrude downward from the base.

A length by which the first boss protrudes from the base may be formed to be greater than a length by which the second boss protrudes from the base.

The boss may include a boss inner wall forming an insertion hole into which the fastening member can be inserted, and the boss inner wall may have a diameter gradually increasing in a direction protruding from the base.

The boss may include a boss outer wall forming an outer surface of the boss, and the boss outer wall may have a diameter gradually decreasing in the direction of protruding from the base.

The vibration absorption member may include a receiving groove in an outer surface thereof, and the compressor support may be received in the receiving groove.

The vibration absorption member may include at least one rib provided on the outer surface thereof to absorb the vibration generated from the compressor The boss may further include at least one boss support on an outer surface thereof, wherein the boss support may connect the boss and the base.

An air conditioner according to an aspect of the present invention includes a heat exchanger, a tray drain configured to guide condensate generated from the heat exchanger, and a base configured to support the tray drain and including a separation prevention part, wherein the tray drain further includes at least one hook portion hook-fixed to a lower end thereof by the separation prevention part.

The hook portion may include an extended portion configured to extend from the tray drain and a bent portion bent from the extended portion.

The base may further include a hook groove configured to accommodate the bent portion, and since the bent portion is accommodated in the hook groove, the tray drain may be fixed to the base.

The separation prevention part may be provided to be elastically transformable in a vertical direction.

The hook portion may be disposed to be spaced apart from the tray drain along an edge of the tray drain.

The separation prevention part may be disposed to be spaced apart from the base along an edge of the base.

According to an aspect of the present invention, a compressor fixing structure which has few components and is simply assembled can be provided.

According to an aspect of the present invention, a compressor fixing structure of which strength is increased and reliability is improved can be provided.

According to an aspect of the present invention, a compressor fixing structure in which a fastening member maintains a predetermined distance from a vibration absorption member to prevent an abnormal noise can be provided.

According to an aspect of the present invention, a tray drain fixing structure of which productivity and serviceability are improved due to simplification of an assembly structure can be provided.

BRIEF DESCRIPTION OF THE DRAWINGS

FIG. 1 is a perspective view illustrating a dehumidifier, of which a front surface is visible, according to one embodiment of the present invention.

FIG. 2 is a perspective view illustrating the dehumidifier, of which a rear surface is visible, according to one embodiment of the present invention.

FIG. 3 is a cross-sectional view of part A-A' in FIG. 2.

FIG. 4 is an exploded perspective view of the dehumidifier according to one embodiment of the present invention.

FIGS. 5 and 6 are views sequentially illustrating movement paths of condensate generated from the dehumidifier according to one embodiment of the present invention.

FIG. 7 is a perspective view illustrating a compressor fixing structure of the dehumidifier according to one embodiment of the present invention.

FIG. 8 is an exploded perspective view of the compressor fixing structure in FIG. 7.

FIG. 9 is a view illustrating a fastening member, a compressor support, and a vibration absorption member of the dehumidifier according to one embodiment of the present invention.

FIG. 10 is a cross-sectional view of part B-B' in FIG. 7.

FIG. 11 is an enlarged view of part C in FIG. 10.

FIG. 12 is an enlarged view of part D in FIG. 10.

FIG. 13 is a cross-sectional view of the fastening member in FIG. 10

FIG. 14 is a perspective view illustrating a base of the dehumidifier according to one embodiment of the present invention from below.

FIG. 15 is an enlarged view of part E in FIG. 14.

FIG. 16 is a perspective view illustrating a tray drain fixing structure of the dehumidifier according to one embodiment of the present invention.

FIG. 17 is an exploded perspective view illustrating the tray drain fixing structure in FIG. 16.

FIG. 18 is a cross-sectional view of part F-F' in FIG. 16.

DETAILED DESCRIPTION

Hereinafter, embodiments according to the present invention will be described in detail. Meanwhile, the terms "front end," "rear end," "upper portion," "lower portion," "upper end," "lower end," etc. used in the below-described description are defined on the basis of the drawings, and a shape and a location of each component are not restrained by the terms.

Generally, air conditioners are apparatus configured to adjust temperature, humidity, flows of air, distribution of flows of air, and the like suitable for human activity and remove dust in air using a refrigeration cycle. The air conditioner includes a humidifier, a dehumidifier, an air filter, an air precooler, etc.

Hereinafter, a dehumidifier according to one embodiment of an air conditioner of the present invention will be described.

FIG. 1 is a perspective view illustrating a dehumidifier, of which a front surface is visible, according to one embodiment of the present invention, FIG. 2 is a perspective view illustrating the dehumidifier, of which a rear surface is visible, according to one embodiment of the present invention, FIG. 3 is a cross-sectional view of part A-A' in FIG. 2, FIG. 4 is an exploded perspective view of the dehumidifier according to one embodiment of the present invention, and FIGS. 5 and 6 are views sequentially illustrating movement paths of condensate generated from the dehumidifier according to one embodiment of the present invention.

As shown in FIGS. 1 to 6, a dehumidifier 1 may include a main body 10 forming an exterior of the dehumidifier 1 and having a suction port 13 and a discharge port 11, and a water tank 50 detachably provided on the main body 10.

A refrigeration cycle device including a blowing fan 23 configured to forcibly flow air, a compressor 25 configured to compress a refrigerant, a condenser (heat exchanger, 21) configured to condense the refrigerant and dissipate latent heat to the outside, an expansion valve (not shown) configured to expand the refrigerant, and an evaporator (cooler, heat exchanger, 22) configured to evaporate the refrigerant to absorb latent heat from the outside and condense water vapor of the surrounding air may be provided inside the main body 10.

Further, the main body 10 may include a tray drain 26 configured to guide condensate generated from the evaporator 22, an auxiliary water tank 27 configured to collect the condensate guided by the tray drain 26, a pump 24 configured to pump the condensate collected in the auxiliary water tank 27 to the water tank 50, and a drain pipe 62 configured to guide the condensate pumped by the pump 24 to the water tank 50 above the main body 10.

Air introduced through the suction port 13 of the main body 10 may pass through the condenser 21 to be heated after being cooled by the evaporator 22 of the refrigeration cycle device to be dehumidified, and then the dry air may be discharged to the outside of the main body 10 through the discharge port 11.

Meanwhile, the main body 10 may include a front case 10*a* forming a front surface of the main body 10, a rear case 10*b* coupled to the front case 10*a* to form a rear surface of the main body 10, a bottom case 10*c* forming a bottom of the main body 10, and a support frame 16 provided between the front case 10*a* and the rear case 10*b* to support various components.

Wheels 10*d* may be provided under the bottom case 10*c* so that the main body 10 may be easily moved.

The suction port 13 may be formed in the rear surface of the main body 10, and the discharge port 11 may be formed at an upper side of the main body 10. In the embodiment of the present invention, although an example of the discharge port is shown to be formed at an upper side of the main body 10, the spirit of the present invention is not limited thereto. For example, the discharge port may be formed in the front case 10*a* of the main body 10.

A suction grill 14 configured to filter foreign substances may be provided on the suction port 13, and a discharge port cover 12 configured to adjust a direction of the discharged air and to open and close the discharge port 11 may be provided on the discharge port 11.

The refrigeration cycle device including the compressor 25, the condenser 21, the expansion valve, and the evaporator 22 is provided inside the main body 10. The compressor 25 may be disposed in a lower portion of the main body 10, the evaporator 22 may be disposed close to the suction port 13 at a rear side, and the condenser 21 may be disposed in front of the evaporator 22.

The blowing fan 23 receives a rotational force from a driving motor 23*a* to be rotatable. The blowing fan 23 may suction the air from a rear side of the main body 10 and forcibly flow the air so that the air is discharged upward from the main body 10 after the air sequentially passes through the evaporator 22 and the condenser 21. An airflow guide 28 configured to guide a direction of a flow of the air may be provided inside the main body 10. The blowing fan 23 may be a centrifugal fan configured to suction the air in an axial direction and discharge the air in a radial direction, and an airflow exit 29 formed at a location corresponding to the discharge port 11 of the main body 10 may be provided in the airflow guide 28.

Further, various electronic device boxes 30 may be provided in an inner lower portion of the main body 10.

As described above, the air introduced into the main body 10 is cooled to a dew point or less in the evaporator 22 and water vapor in the air is condensed, and then the dried air passes through the condenser 21 to be heated and may be discharged to the outside of the main body 10 in a state in which relative humidity has been lowered.

The condensate condensed in the evaporator 22 may fall down from the evaporator 22 after flowing downward through the evaporator 22, and the tray drain 26 configured to guide the falling condensate may be provided under the evaporator 22.

The tray drain 26 guides the condensate to the auxiliary water tank 27, and to this end, a drain duct 26 may be formed to be inclined toward the auxiliary water tank 27. The tray drain 26 may be formed in a size corresponding to the evaporator 22 to cover the whole area of the evaporator 22. A drain flow path 63 may be formed to be inclined on the tray drain 26 so that the condensate is accommodated and moves to the auxiliary water tank 27. An installation part 61 for installing the evaporator 22 and the condenser 21 may be provided on the tray drain 26.

The installation part 61 of the tray drain 26 may include a first installation part 61*a* for installing the evaporator 22 and a second installation part 61*b* for installing the condenser 21. The first installation part 61*a* and the second installation part 61*b* may be formed so that the evaporator 22 and the condenser 21 may be installed to be spaced apart from the drain flow path 63 through which the condensate falling downward from the evaporator 22 flows.

The auxiliary water tank 27 is provided to store the condensate. In the embodiment, although an example in which the tray drain 26 and the auxiliary water tank 27 are separately formed is shown, the spirit of the present invention is not limited thereto. For example, the tray drain may be integrally formed with the auxiliary water tank.

Meanwhile, a water level sensor (not shown) may be provided in the auxiliary water tank 27. When a water level in the auxiliary water tank 27 reaches a full water level or a predetermined water level, the pump 24 may operate to pump the condensate in the auxiliary water tank 27.

The pump 24 may be a centrifugal pump formed of a pump motor (not shown) configured to generate a rotational force of the pump 24, and rotating blades (not shown) configured to receive the rotational force from the pump motor to rotate. The condensate pumped by the pump 24 may be guided to the water tank 50 provided above the main body 10 by the drain pipe 62.

A water tank mounting part 40 on which the water tank 50 is mounted may be provided above the main body 10.

FIG. 7 is a perspective view illustrating a compressor fixing structure of the dehumidifier according to one embodiment of the present invention, FIG. 8 is an exploded perspective view of the compressor fixing structure in FIG. 7, and FIG. 9 is a view illustrating a fastening member, a compressor support, and a vibration absorption member of the dehumidifier according to one embodiment of the present invention.

As shown in FIG. 7, the compressor 25 configured to compress the refrigerant may be installed to be fixed to one side of a base 10*c*. The compressor 25 may be located under the tray drain 26 to be vertical with the evaporator 22.

As shown in FIG. 8, in order to fix the compressor 25 to the base 10*c*, a fastening member 100, a vibration absorption member 120, a compressor support 110, and a boss 130 may be provided. That is, since the vibration absorption member 120 is inserted into the boss 130, the compressor support 110 provided under the compressor 25 is fit-coupled with a receiving groove 122 (see FIG. 9) of the vibration absorption member 120, and the fastening member 100 is inserted into the boss 130 and the vibration absorption member 120, the compressor 25 may be fixed to the base 10*c*.

As shown in FIGS. 7 to 9, the compressor support 110 may be provided under the compressor 25 to connect the compressor 25 and the base 10*c*. The compressor support 110 may be provided as a bracket. Further, the compressor support 110 may include at least one fitting hole 111 therein to be fit-coupled with the vibration absorption member 120.

The compressor support 110 may include fitting holes 111 having different diameters from each other. Accordingly, even when the vibration absorption members 120 have different diameters, one compressor support 110 may be used, and thus, sharing of the compressor support 110 may be performed.

The compressor support 110 may be integrally formed with the compressor 25. Accordingly, the number of components may be reduced. Further, the compressor support 110 may be provided separately from the compressor 25. In this case, only the compressor support may be replaced, and thus it is advantageous for maintenance.

When the compressor support 110 is separately provided, the compressor support 110 may be fixed to the compressor 25 by welding. However, fixing the compressor support 110 is not limited to welding, and the compressor support 110 may be fixed to the compressor 25 by other fastening methods.

At least one boss 130 may be formed in the base 10*c*. The boss 130 may be provided in an approximately cylindrical shape, and may be provided with an insertion hole 133 (see FIG. 12), into which the fastening member 100 may be inserted, in a center portion thereof. The boss 130 provides a fastening space so that the fastening member 100 may be fastened to the base 10*c*. Further, the boss 130 allows the fastening member 100 to be fastened to the base 10*c* without being inclined.

The dehumidifier 1 according to one embodiment of the present invention may include the vibration absorption member 120 configured to absorb vibrations generated from the compressor 25. The vibration absorption member 120 may be formed of an elastic material, for example, a rubber material. The vibration absorption member 120 may include a fastening hole 121 in a center portion thereof. The boss 130 and the fastening member 100 may be inserted into the fastening hole 121. The vibration absorption member 120 may include at least one rib 123 (see FIG. 11) provided on an outer surface thereof to absorb the vibration generated from the compressor 25. Further, the vibration absorption member 120 may include the receiving groove 122 to which the compressor support 110 may be fit-coupled. A diameter of the receiving groove 122 may be equal to or greater than a diameter of the fitting hole 111 of the compressor support 110. Accordingly, the compressor support 110 may be fit-coupled to the receiving groove 122 of the vibration absorption member 120.

In the vibration absorption member 120, a length in a direction in which the fastening member 100 is inserted into the vibration absorption member 120 may be formed to be greater than a length by which the boss 130 protrudes from an upper surface of the base 10*c*. That is, a height of the vibration absorption member 120 may be formed to be greater than a height of the boss 130. Accordingly, the boss 130 and the fastening member 100 may be inserted into the vibration absorption member 120. Conventionally, a vibration absorption member and a boss have similar heights, but in the embodiment of the present invention, since the boss has a lower height and the fastening member replaces a part of the boss, the boss has a higher strength than the conventional boss.

In order to fix the compressor 25 to the base 10*c*, the fastening member 100 configured to couple the vibration absorption member 120, the boss 130, and the compressor support 110 may be included. The fastening member 100 may pass through the fitting hole 111 of the compressor support 110, the fastening hole 121 of the vibration absorption member 120, and the insertion hole 133 of the boss 130. Since the fastening member 100 is fixed to base 10*c*, the compressor support 110 and the vibration absorption member 120 coupled between the fastening member 100 and the base 10*c* may be fixed.

FIG. 10 is a cross-sectional view of the compressor fixing structure of the dehumidifier according to one embodiment of the present invention, FIG. 11 is an enlarged view of part C in FIG. 10, FIG. 12 is an enlarged view of part D in FIG. 10, and FIG. 13 is a cross-sectional view of the fastening member according to one embodiment of the present invention.

As shown in FIGS. 10 to 13, the fastening member 100 may include a body 103. A lower end of the body 103 may be supported by an upper end of the boss 130. In this case, an outer diameter of the body 103 may be similar to a diameter of an outer surface of the boss 130. That is, a portion under the body 103 of the fastening member 100 is inserted into the boss 130, and the body 103 may be in contact with an upper surface of the boss 130. As described above, the height of the boss according to the embodiment of the present invention may be reduced to half of that of the conventional one, and the remaining height may be replaced by the body of the fastening member. Since the height of the boss is reduced, the strength of the boss is increased, and when an impact is generated in the compressor, the body absorbs the impact or transmits the impact to the boss. Accordingly, since the strength of the boss is increased, reliability of the dehumidifier according to the embodiment of the present invention may be improved, and a heavier compressor may be used.

The fastening member 100 may further include a fastening portion 105 configured to extend downward from the body 103. The fastening portion 105 may have a smaller diameter than the body 103. An end of the fastening portion 105 may be provided to be sharp in order to be easily inserted into the insertion hole 133 of the boss 130. Further, a screw thread may be formed on an outer circumferential surface of the fastening portion 105 so that the fastening portion 105 may be screw-coupled to the boss 130. In a portion into which the fastening portion 105 is inserted, a diameter of the insertion hole 133 of the boss 130 may be smaller than a diameter of the fastening portion 105. Accordingly, the fastening portion 105 on which the screw thread is formed may be screw-coupled to the boss 130 while rotating in an inner surface of the boss 130 having a smaller diameter than the fastening portion 105.

The fastening member 100 may include a guide 104 provided between the fastening portion 105 and the body 103, and the guide 104 may have a smaller diameter than the body 103. The guide 104 may include a straight portion 104*a* configured to extend downward from the body 103. Further, the guide 104 may include an inclined portion 104*b* having a gradually decreasing diameter and connected to the fastening portion 105 on an end of the straight portion 104*a*.

Accordingly, the fastening member 100 may not be inclined and may be correctly seated into the boss 130 while being inserted into the boss 130.

The fastening member 100 may include a washer 102 provided above the body 103 to prevent separation of the vibration absorption member 120. The washer 102 may have a greater diameter than the body 103. Further, the washer 102 may be disposed to be spaced apart from the vibration absorption member 120 by a predetermined distance in order to prevent the vibration absorption member and the washer from generating noise by colliding with each other due to the vibrations generated from the compressor when the compressor operates.

The washer 102 may be integrally formed with the fastening member 100. Conventionally, since a washer and a fastening member are separately provided, the number of components and the number of working processes are large, and thus productivity is lowered and material cost is increased, but unlike the conventional washer and fastening member, since the washer is integrally formed with the fastening member, the number of components may be decreased and productivity may be improved. However, the washer 102 and the fastening member 100 do not have to be integrally formed and may be separately formed.

The fastening member 100 may include a head 101 on an upper end of the washer 102. The head 101 may be provided in a shape to which a rotational force is applied. For example, the head 101 may be provided as a hexagonal bolt so that a hexagonal wrench may be used. Further, the head 101 may include a cross groove or a straight groove in an upper end thereof to be rotated by a driver.

As shown in FIG. 12, the boss 130 may include a first boss 131 configured to protrude upward from the base 10*c*, and a second boss 132 configured to protrude downward from the base 10*c*. In this case, a length by which the first boss 131 protrudes from the upper surface of the base 10*c* may be formed to be greater than a length by which the second boss 132 protrudes from a lower surface of the base 10*c*. That is, the first boss 131 may have a greater height than the second boss 132.

The insertion hole 133 formed in the center portion of the boss 130 may be formed to pass through the boss 130. That is, the insertion hole 133 of the first boss 131 and the insertion hole 133 of the second boss 132 may be formed to be connected to each other. Accordingly, a length by which the fastening member may be inserted into the boss is lengthened. When a length of the fastening member is lengthened, an area of a portion in which weight is concentrated and which is screw-coupled to the boss increases, and thus it is advantageous for increasing a fastening force between the fastening member and the boss.

The boss 130 may include a boss inner wall 134 forming the insertion hole 133. In other words, the boss inner wall 134 may be an inner surface of the boss. Further, the boss 130 may include a boss outer wall 135 forming an outer surface of the boss. In other words, the boss outer wall 135 may be the outer surface of the boss. In the boss 130, the boss inner wall 134 may have a diameter gradually increasing in a direction protruding from the base 10*c*. That is, the boss inner wall 134 in the first boss 131 may have a gradually increasing diameter upward, and the boss inner wall 134 in the second boss 132 may have a gradually increasing diameter downward. Further, in the boss 130, the boss outer wall 135 may have a gradually decreasing diameter in a direction protruding from the base 10*c*. The boss outer wall 135 in the first boss 131 may have a gradually decreasing diameter upward, and the boss outer wall 135 in the second boss 132 may have a gradually decreasing diameter downward. In the case in which the base 10*c* is manufactured by injection-molding, the purpose of the above is the removal of a mold when the base 10*c* is consolidated or cured. Further, since the area of the portion in which weight is concentrated and which allows the fastening member to be screw-coupled to the boss increases, the fastening force between the fastening member and the boss may increase.

In the first boss 131 protruding upward from the boss 130, the diameter of the boss inner wall 134 may vary to correspond to the guide 104 of the fastening member. That is, the diameter of the boss inner wall 134 of the first boss may vary to correspond to the inclined portion 104*b* of the guide 104. This is for guiding the correct insertion of the fastening member by providing the corresponding boss 130 when the guide 104 is provided.

As shown in FIG. 11, the vibration absorption member 120 may be fit-coupled to the outer surface of the boss 130, and the fastening member 100 may be inserted into the boss 130 and the vibration absorption member 120. In this case, the vibration absorption member 120 may be disposed to be spaced apart from the body 103 of the fastening member 100 by a predetermined distance in order to prevent the body and the vibration absorption member from generating noise by colliding with each other due to the vibrations generated from the compressor when the compressor operates.

FIG. 14 is a perspective view illustrating a base of the dehumidifier according to one embodiment of the present invention from below, and FIG. 15 is an enlarged view of part E in FIG. 14.

As shown in FIGS. 14 and 15, the boss 130 may include at least one boss support 136 formed on an outer surface thereof. The boss support 136 may be provided to connect the boss 130 and the base 10*c*. In the boss support 136, a height of the boss support 136 may further decrease when the height of the boss 130 further increases. That is, on the upper end of the boss 130, the boss support 136 may have no boundary with the outer surface of the boss 130. The height of the boss support 136 may further decrease when further spaced apart from the boss outer surface. That is, the boss support 136 may be closer to the base 10*c* when further spaced apart from the boss outer surface.

As shown in FIG. 15, a plurality of boss supports 136 may be disposed along an edge of the boss 130 to be spaced apart from each other by predetermined distances. Since the plurality of boss supports are provided, the strength of the boss is increased.

FIG. 16 is a perspective view illustrating a tray drain fixing structure of the dehumidifier according to one embodiment of the present invention, FIG. 17 is an exploded perspective view illustrating the tray drain fixing structure in FIG. 16, and FIG. 18 is a cross-sectional view illustrating an operation of mounting the tray drain of the dehumidifier on the base according to one embodiment of the present invention.

As shown in FIGS. 16 to 18, a tray drain 26 may be detachably provided on the base 10*c*. The base 10*c* may include at least one separation prevention part 140 to fix the tray drain 26. The tray drain 26 may include at least one hook portion 150 hook-fixed by the separation prevention part 140.

The hook portion 150 may include an extended portion 151 configured to extend downward from a lower end of the tray drain 26 and a bent portion 152 bent from the extended portion 151. For example, the hook portion 150 may be provided in an L shape.

The separation prevention part 140 may be provided to be elastically transformed in a vertical direction. Accordingly, when the hook portion 150 is in the process of becoming detached from the base 10*c*, the separation prevention part 140 receives a force in a downward direction and is bent downward, and when the hook portion 150 becomes completely mounted on the base 10*c* or detached from the base, the separation prevention part 140 may be restored to the original shape.

As shown in FIG. 16 to FIG. 18, one side of the separation prevention part 140 may protrude upward from the base 10*c*, and the other side of the separation prevention part 140 may be separated from the base 10*c*. That is, the separation prevention part 140 may be formed by bending a part of the base 10*c*. The one side of the separation prevention part 140 is provided by vertically bending the part of the base 10*c*, and the remaining surfaces excluding the one side of the separation prevention part 140 may be separated from the base 10*c* by a predetermined distance. For example, a ⊏ shaped portion of the separation prevention part 140 excluding the one side of the separation prevention part 140 may be separated from the base 10*c* by a predetermined distance.

The base 10*c* may include a hook groove 141 provided to accommodate the bent portion 152. A hook wall 142 may be provided on the hook groove 141. When the tray drain 26 is mounted on the base 10*c*, the hook wall 142 may be in surface contact with the extended portion 151. When the tray drain 26 is mounted on the base 10*c*, the hook wall 142 may prevent the extended portion 151 from further moving toward an inner side of the hook groove 141. In this case, the bent portion 152 may be accommodated in the hook groove 141. That is, the tray drain 26 may be slide-coupled to the base 10*c*.

When the tray drain 26 is slide-coupled to the base 10*c*, the separation prevention part 140 may prevent the hook portion 150 from being separated in a direction toward the separation prevention part 140. Accordingly, the tray drain 26 may be fixed to the base 10*c* without being moved.

When the tray drain 26 is being detached from the base 10*c*, the separation prevention part 140 receives a force in a downward direction and is elastically transformed, and then the tray drain 26 may be moved in a direction opposite an insertion direction thereof. Although vertical hook-coupling and screw-fixing are conventionally used to fix a tray drain to a base, the present invention is advantageous for easily assembly and disassembly using a lateral sliding method without the screw-fixing.

Although a few embodiments of the present invention have been shown and described, it should be appreciated by those skilled in the art that changes may be made to the embodiments without departing from the principles and spirit of the present invention, and the scope of the present invention is defined in the claims and their equivalents.

The invention claimed is:

1. An air conditioner comprising:

a compressor configured to compress a refrigerant;

a base configured to support the compressor;

a compressor support coupled to the base and configured to support the compressor;

at least one boss configured to protrude from the base and including an insertion hole with an inclined inner surface;

a vibration absorption member disposed between the compressor support and the boss, configured to absorb vibrations generated from the compressor, and having a height greater than a height of the boss; and a fastening member configured to couple the boss, the vibration absorption member, and the compressor support, the fastening member including:

a head, a body protruding from a bottom surface of the head, wherein a lower end of the body is supported by the boss, and a fastening portion protruding from a bottom surface of the body, wherein the boss protrudes from the base into a hole of the vibration absorption member, wherein the fastening member is inserted into the insertion hole of the boss and the vibration absorption member, and at least a part of the fastening member protrudes through the boss and downward from a lower surface of the base at least the part of the fastening member including an inclined portion that is seated on the inclined inner surface of the insertion hole in the at least one boss, wherein the fastening portion has a smaller diameter than the body, and the fastening member further includes a guide provided between the fastening portion and the body, wherein the guide is provided on an upper end of the fastening portion to guide insertion of the fastening member into the boss, and the guide includes the inclined portion seated inside the boss on the inclined inner surface of the boss, wherein the inclined portion has a diameter that gradually decreases in a direction moving away from the head, and the inclined inner surface has a diameter that gradually decreases in a same direction as the inclined portion and corresponds to the diameter of the inclined portion.

2. The air conditioner of claim 1, wherein, in the vibration absorption member, a length in a first direction, in which the fastening member is inserted into the vibration absorption member, is formed to be greater than a length by which the boss protrudes from an upper surface of the base.

3. The air conditioner of claim 1, wherein the body is disposed to be spaced apart from the vibration absorption member.

4. The air conditioner of claim 1, wherein, in the fastening portion, a screw thread is formed on an outer circumferential surface of the fastening portion so that the fastening member is screw-coupled to the boss.

5. The air conditioner of claim 1, wherein an inner diameter of the boss varies to correspond to a diameter of the guide.

6. The air conditioner of claim 1, wherein the fastening member further includes a washer provided on an upper portion of the body to prevent separation of the vibration absorption member.

7. The air conditioner of claim 6, wherein the washer is disposed to be spaced apart from the vibration absorption member.

8. The air conditioner of claim 6, wherein the washer is provided separately from the fastening member.

9. The air conditioner of claim 6, wherein the head is provided on an upper end of the washer.

10. The air conditioner of claim 9, wherein the head is provided in a shape to which a rotational force is applied.

11. The air conditioner of claim 1, wherein the vibration absorption member is formed of an elastic material.

12. An air conditioner comprising:

a compressor configured to compress a refrigerant;

a base configured to support the compressor;

a compressor support coupled to the base and configured to support the compressor;

at least one boss configured to protrude from the base and including an insertion hole with an inclined inner surface;

a vibration absorption member disposed between the compressor support and the boss, configured to absorb vibrations generated from the compressor, and having a height greater than a height of the boss; and a fastening member configured to couple the boss, the vibration absorption member, and the compressor support, the fastening member including:

a head, a body protruding from a bottom surface of the head, wherein the body is supported by the boss, and a fastening portion protruding from a bottom surface of the body, wherein the boss protrudes from the base into a hole of the vibration absorption member, wherein the fastening member is inserted into the insertion hole of the boss and the vibration absorption member, and at least a part of the fastening member protrudes through the boss and downward from a lower surface of the base at least the part of the fastening member including an inclined portion that is seated on the inclined inner surface of the insertion hole in the at least one boss, wherein the base is integrally formed with the boss, wherein the fastening portion has a smaller diameter than the body, and the fastening member further includes a guide provided between the fastening portion and the body, wherein the guide is provided on an upper end of the fastening portion to guide insertion of the fastening member into the boss, and includes the inclined portion seated inside the boss on the inclined inner surface of the boss, wherein the inclined portion has a diameter that gradually decreases in a direction moving away from the head, and the inclined inner surface has a diameter that gradually decreases in a same direction as the inclined portion and corresponds to the diameter of the inclined portion.

13. The air conditioner of claim 12, wherein the body is disposed to be spaced apart from the vibration absorption member.

14. The air conditioner of claim 12, wherein, in the fastening portion, a screw thread is formed on an outer circumferential surface of the fastening portion so that the fastening member is screw-coupled to the boss.

* * * * *